US012509964B2

(12) United States Patent
Louden et al.

(10) Patent No.: US 12,509,964 B2
(45) Date of Patent: Dec. 30, 2025

(54) DOWNHOLE HEATING

(71) Applicant: ISOL8 (HOLDINGS) LIMITED, Aberdeen (GB)

(72) Inventors: Andrew Louden, Aberdeen (GB); William Edward Lowry, Port Townsend, WA (US); Niall Lipp, Avoch (GB)

(73) Assignee: ISOL8 (HOLDINGS) LIMITED, Aberdeen (GB)

( * ) Notice: Subject to any disclaimer, the term of this patent is extended or adjusted under 35 U.S.C. 154(b) by 0 days.

(21) Appl. No.: 18/832,205

(22) PCT Filed: Jan. 24, 2023

(86) PCT No.: PCT/EP2023/025034
§ 371 (c)(1),
(2) Date: Jul. 23, 2024

(87) PCT Pub. No.: WO2023/138905
PCT Pub. Date: Jul. 27, 2023

(65) Prior Publication Data

US 2025/0198256 A1 Jun. 19, 2025

(30) Foreign Application Priority Data

Jan. 24, 2022 (GB) ..... 2200887

(51) Int. Cl.
*E21B 36/00* (2006.01)

(52) U.S. Cl.
CPC ..... *E21B 36/008* (2013.01); *E21B 36/003* (2013.01)

(58) Field of Classification Search
CPC ..... E21B 36/00; E21B 36/003; E21B 36/008
See application file for complete search history.

(56) References Cited

U.S. PATENT DOCUMENTS

| | | | |
|---|---|---|---|
| 1,329,559 | A | 2/1920 | Tesla |
| 3,817,332 | A | 6/1974 | Berry et al. |
| 4,507,082 | A | 3/1985 | Wardlaw, III |
| 4,585,158 | A | 4/1986 | Wardlaw, III |

(Continued)

FOREIGN PATENT DOCUMENTS

| | | | |
|---|---|---|---|
| GB | 2586796 | A | 3/2021 |
| SU | 457787 | A1 | 1/1975 |

(Continued)

OTHER PUBLICATIONS

International Search Report and Written Opinion for Int. App. No. PCT/EP2023/025034, mailed Feb. 20, 2023.

(Continued)

*Primary Examiner* — Aaron L Lembo
(74) *Attorney, Agent, or Firm* — MCDONNELL BOEHNEN HULBERT & BERGHOFF LLP

(57) ABSTRACT

A downhole heating method comprises locating a heater in a fluid-filled downhole bore, activating the heater to heat the bore and the fluid therein, and restricting or disrupting convection-induced flow of the heated fluid in the bore. The convection-induced flow may be restricted by providing a radially extending flow barrier or heat deflector. Alternatively, or in addition, the flow may be disrupted by configuring a surface of the heater to disrupt axial flow.

20 Claims, 8 Drawing Sheets

(56) References Cited

U.S. PATENT DOCUMENTS

| | | | | |
|---|---|---|---|---|
| 6,032,733 | A * | 3/2000 | Ludwig | E21B 17/06 166/385 |
| 11,867,020 | B2 * | 1/2024 | Carragher | E21B 36/003 |
| 12,116,866 | B2 * | 10/2024 | Louden | E21B 33/128 |
| 2009/0151937 | A1 | 6/2009 | Goodwin et al. | |
| 2017/0356280 | A1 | 12/2017 | Sylvester | |
| 2024/0102360 | A1 | 3/2024 | Carragher | |
| 2024/0295157 | A1 * | 9/2024 | Vasques | E21B 33/1277 |

FOREIGN PATENT DOCUMENTS

| | | | |
|---|---|---|---|
| WO | 2020/144091 | A2 | 7/2020 |
| WO | 2020/216475 | A1 | 10/2020 |
| WO | 2021/043443 | A1 | 3/2021 |
| WO | 2021/043444 | A1 | 3/2021 |

OTHER PUBLICATIONS

GB Search Report for GB application 2200887.4 (published as GB 2614911), dated Mar. 2, 2022.

* cited by examiner

DOWNHOLE HEATING

CROSS REFERENCE TO RELATED APPLICATIONS

The present application is a U.S. National Phase Application pursuant to 35 U.S.C. § 371 of International Application No. PCT/EP2023/025034 filed Jan. 24, 2023, which claims priority to GB Patent Application No. 2200887.4 filed Jan. 24, 2022. The entire disclosure contents of these applications are herewith incorporated by reference into the present application.

FIELD

This disclosure relates to heating in downhole environments, such as the use of heaters in bores used to access subsurface hydrocarbon reservoirs.

BACKGROUND

Heaters are used in a range of downhole operations, such as described in, for example, our WO 2020/144091, WO 2020/216475, WO 2021/043443, WO 2021/043444, and GB2586796, the disclosures of which are incorporated herein in their entirety. Downhole heaters may take a variety of forms, including electric heaters and exothermic reaction heaters, such as thermite heaters. The heat generated may be utilised to, for example, melt or soften a sealing material, such as a metal or an alloy, which subsequently cools and solidifies to form a seal or other structure. In other examples exothermic reaction products are used to form an obstruction in the well bore, or liquidised thermite or other reaction products may be used to remove wellbore elements such as tubing and casing.

SUMMARY

According to a first aspect of the disclosure there is provided a downhole heating method comprising:

locating a heater in a fluid-filled downhole bore;

activating the heater to heat the bore and the fluid therein; and restricting convection-induced flow of the heated fluid.

Downhole bores, such as those used to access subsea hydrocarbon-bearing rock formations, are typically filled with liquid. Accordingly, a downhole heater will tend to be surrounded by an annular volume of fluid, such as oil, water, or a water-based fluid. Depending on the form and purpose of the heater, upper and lower surfaces of the heater may also be in contact with the fluid in the bore. Water, as an example, has a large specific heat capacity and will therefore absorb substantial amounts of heat energy before experiencing a significant temperature rise. Further, localised heating in a fluid-filled bore will induce convection currents, which will result in warmer fluid rising in the bore and moving away from the heater and being replaced by cooler fluid. Thus, a substantial proportion of the heat energy generated by a downhole heater will tend to be absorbed by the fluid in the bore, leading to less energy being transferred to the object or material the heater has been provided to heat.

By restricting convection-induced flow of the heated fluid, the heat energy generated by the heater will tend to be retained or concentrated in a smaller area of the bore, and thus may be utilised more efficiently and effectively.

The heater may be utilised to heat an object or material located in the bore, such as a volume of alloy or metal. Thus, the heater may be used to, for example, heat and soften a sealing material, such as low melting point alloy, which then moves or flows and subsequently cools and hardens in a sealing configuration, for example forming a plug in the bore. Conversely, the heater may be used to soften an existing plug, to allow the plug to be removed or assume a non-sealing configuration.

Alternatively, or in addition, the heater may be utilised to heat the bore wall, for example bore-lining tubing, or material surrounding the wall, such as cement, rock formations surrounding the bore, or annulus fluid.

The heater may be used to melt or remove an existing wellbore structure, for example the heater may melt or cut a section of tubing or casing.

Elements of the activated heater may move or flow to form an obstruction in the wellbore.

The heater may be an exothermic reaction heater, for example a thermite heater.

The method may comprise restricting axial flow of the fluid in an annular volume around, above, or below a heater. The flow may be restricted by locating a barrier in the fluid, or by disrupting flow of the fluid. Disrupting the flow of fluid may be achieved by provision of formations on an external surface of the heater or other body which induce lateral deflections in the flow, for example as achieved by the formations as featured in a Tesla valve, as described in U.S. Pat. No. 1,329,559.

The bore may be defined by a bore-lining tubing. The tubing may be surrounded by a fluid-filled annulus. Convection-induced flow within the annulus may also be restricted or disrupted, for example by expanding a portion of the bore-lining tubing to extend into the annulus, or by utilising an existing packer or tubing hanger.

The heater may comprise multiple heating units or sections. The heater may be translated to locate an activated heating unit at a selected location in the bore or may remain stationary in a bore while different portions of the heater are activated. The heating units may be activated at intervals or in sequence. A heat deflector such as a flow-restricting member or barrier may be associated with each unit. In another example the heater may be elongated and a heating reaction, for example a thermite reaction, may be initiated at one end of the heater and then translate axially through the heater, such that the hottest part of the heater moves along the length of the heater. In such a situation the heater may be translated to maintain the hottest part of the heater at a selected location in the bore. Heat deflectors may be provided at intervals along the length of the heater.

According to a second aspect of the disclosure there is provided a downhole heater comprising a body for location in a bore and a heat deflector for extending from the body towards a surrounding bore wall.

The heat deflector may have a retracted configuration and a larger diameter extended configuration. The retracted configuration may facilitate translation of the heater through the bore. In the larger diameter extended configuration the heat deflector may be adapted to engage the bore wall and may create a barrier to flow between the heater and the bore wall. The heat deflector may be reconfigured on activation of the heater. For example, activation of the heater may cause a heat deflector retainer to soften or fail, allowing reconfiguration of the deflector. Alternatively, or in addition, the heat deflector may be formed of a material that extends or expands on exposure to selected downhole fluids or temperatures, for example a swelling elastomer or a shape memory material.

The deflector may be biased to assume the extended configuration and may be releasably retained in the retracted configuration, for example by provision of a retaining member around the deflector. The retaining member may be reconfigurable to permit extension of the deflector.

In other examples the heat deflector may have a substantially fixed configuration and define a diameter smaller than the bore wall, allowing the heater to be run into the bore with the deflector in an extended configuration. Such a heat deflector may be resilient or deformable to facilitate passage through bore restrictions. In other examples the heat deflector may define a diameter the same as or larger than the bore wall but may be resilient or deformable to allow the deflector to be run into the bore.

The deflector may take any appropriate form, for example a disc or cup, and may be formed of a unitary member or of multiple members, for example a plurality of petals. A portion of the deflector, such as an outer edge of the deflector, may be formed of a deformable member or material to facilitate formation of a fluid-tight contact between the extended deflector and the bore wall. In one example a silicone ring is provided at the outer edge of the deflector. In other examples the deflector may not extend to contact the bore wall and there may be clearance between the deflector and the bore wall.

The heater may be an exothermic reaction heater, for example a thermite heater. The heater may include a volume of thermite. The heater may include an initiator at one end of the heater, and the reaction may progress through the thermite from one end of the heater to the other end. The initiator may be provided at an upper end of the heater, such that the thermite reaction progresses from the top down. Alternatively, the initiator may be provided at the lower end of the heater, such that the thermite reaction progresses from the bottom up. In other examples multiple initiators may be provided along the length of the heater.

The heater may be elongate, and a deflector may be provided at an upper end of the heater. Multiple axially spaced deflectors may be provided.

Disruption of the fluid convection flow can also be achieved by varying the profile on the tool body such that disrupted or turbulent flow is established. The turbulent flow can disrupt the convection currents and in well geometries with low clearance may act akin to a one-way valve.

An example of the disclosure relates to a downhole heating method comprising:

- providing a heater and a heat deflector, and retaining the heat deflector in a retracted configuration with a fusible retainer;
- locating the heater and the heat deflector in a fluid-filled downhole bore;
- activating the heater to heat the bore and the fluid therein, and to heat the fusible retainer and reconfigure the heat deflector from the retracted configuration to an extended configuration to restrict convection-induced flow of the heated fluid.

A further example of the disclosure relates to a downhole heater comprising a body for location in a bore, a heat deflector and a fusible retainer, the heat deflector having a retracted configuration and a larger diameter extended configuration for restricting convection-induced flow in the bore, the heat deflector being maintained in the retracted configuration by the fusible retainer whereby the heat deflector is reconfigured to the larger diameter extended configuration on activation of the heater.

These and other features of the disclosure as described herein, and as recited in the appended claims, may be combined, or may have individual utility.

BRIEF DESCRIPTION OF THE DRAWINGS

These and other aspects of the disclosure will now be described, by way of example, with reference to the accompanying drawings, in which.

DETAILED DESCRIPTION

Figure 1:
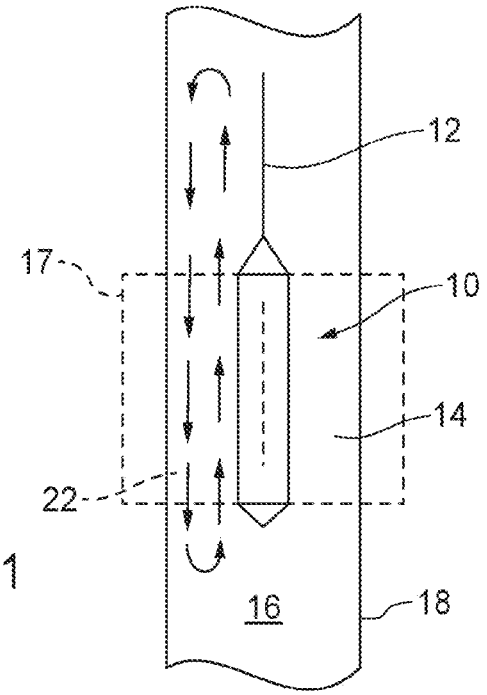
FIG. 1 is a schematic of a heater in a bore.

Reference is first made to FIG. 1 of the drawings, which is a schematic of a heater 10 suspended on a suitable support, such as wireline 12, in a bore 14 filled with fluid, such as water 16. The heater 10 may be utilised to heat a target area 17 of bore-lining casing 18. To facilitate translation of the heater 10 through the bore 14 from surface to the heating location, the heater 10 defines an outer diameter which is smaller than the internal diameter of the casing 18.

On activation, heat energy generated by the heater 10 is transferred to the target area of the casing 17 by any combination of conduction, convection, and radiation. However, as the temperature of the fluid 16 surrounding the heater 10 increases the density of the heated fluid is reduced and a convection current 22 is established; by way of example, the current 22 may involve the heated fluid rising in the bore 14 to a height some distance above the heater 10, then cooling and moving downwards.

The heater 10 thus heats a relatively large volume of the fluid 16 around, above and below the heater 10, and heat will be transferred from the heated fluid to an extended section of the casing 18. Given that the fluid has a large specific heat capacity, the heating of the fluid will absorb a substantial proportion of the heat energy produced by the heater 10, and significantly reduce that heat energy that is available to be transferred to the target area 17.

Figure 2:
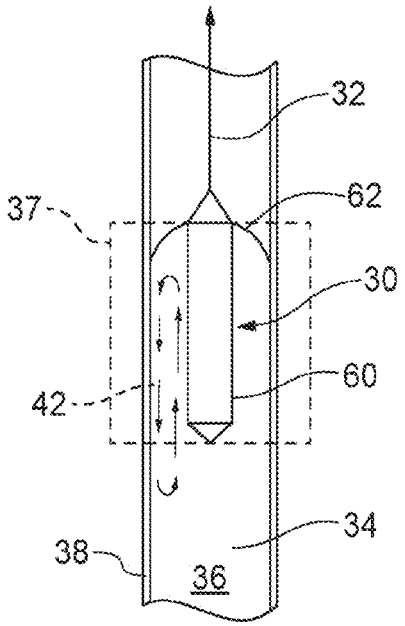
FIG. 2 is a schematic of a downhole heating method in accordance with a first example of an aspect of the disclosure.

Reference is now made to FIG. 2 of the drawings, a schematic of a downhole heating method in accordance with a first example of an aspect of the disclosure. The drawing illustrates a heater 30 suspended on a wireline 32 in a fluid-filled bore 34. The heater 30 comprises a generally cylindrical body 60 having a heat deflector 62 extending radially outwards from an upper end of the body 60. An outer edge of the deflector 62 contacts the internal surface of the casing 38.

On activation, and in a generally similar fashion to the heater 10 described above, heat generated by the heater 30 is transferred to the target area of the casing 37 by any combination of conduction, convection, and radiation. As the temperature of the fluid 36 adjacent the heater 30 increases the density of the heated fluid is reduced and a convection current 42 is established. The heated fluid rises in the bore 34, but only as far as the deflector 62, and thus does not pass beyond the upper end of the heater 30.

The extent of the convection current 42 is significantly less than would be the case in the absence of the deflector 62, such that a significantly smaller volume of fluid 36 is subject to heating. Accordingly, the temperature rise experienced by the fluid surrounding the heater 30 is significantly increased, less heat energy is lost to the larger volume of fluid in the bore 34 axially above the heater 30, and thus to other areas of the casing 38 remote from the target area 37, and more heat energy is transferred from the heater 30 to the targeted area of the casing 38. The heated fluid circulating with the current 42 will also transfer greater heat radially from the heater 30 to the target area 37.

By way of example, a thermite heater 10 with an outer diameter of 3½" (8.89 cm) located within a water-filled casing 18 with an inner diameter of 4½" (11.43 cm) as shown in FIG. 1, with no heat deflector, will result in a water temperature near the heater 10 of around 300° C., dropping off rapidly to 110° C. (near the ambient fluid temperature) at a distance of less than 0.2 cm from the heater surface. The upward convective velocity of the water may reach 3 meters/second. However, with the deflector 62 at the top of the heater 30 as shown in FIG. 2, the water temperature across the gap between the heater 30 and the casing 38 will be more than 450° C., and the convective velocity ranging from +0.3 m/s (upward flow) at the heater surface to −0.3 m/s (downward flow) at the casing surface, indicative of the formation of a small convection cell. This serves to transfer the bulk of the generated heat in a radial direction to the casing 38.

Figure 3:
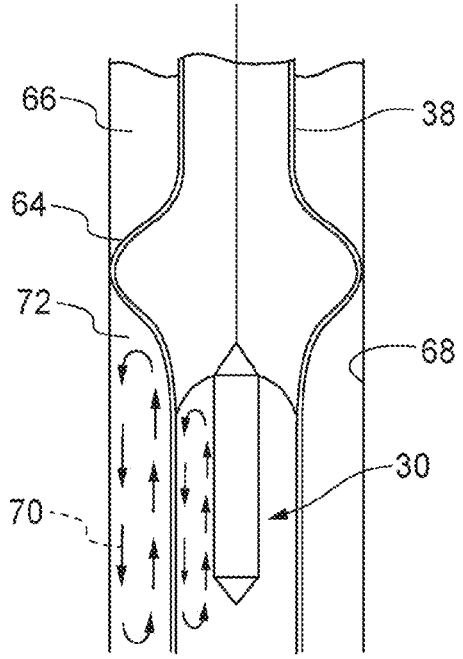
FIG. 3 is a schematic of a downhole heating method in accordance with a second example of an aspect of the disclosure.

In FIG. 3 of the drawings, an area of the casing 38 above the heater 30 has been radially expanded or extended to create a lip 64 which extends into an annulus 66 between the casing 38 and a surrounding bore wall 68. Heat transferred through or from the casing 38 surrounding the heater 30 creates a convection current 70 in the fluid 72 in the annulus 66, however the circulation of the current 70 is restricted by the lip 64. As a result, a smaller volume of fluid 72 in the annulus 66 is subject to heating, and there is a greater increase in the temperature of the heated fluid 72, such that more heat energy is transferred radially to the bore wall 68.

Figure 4:
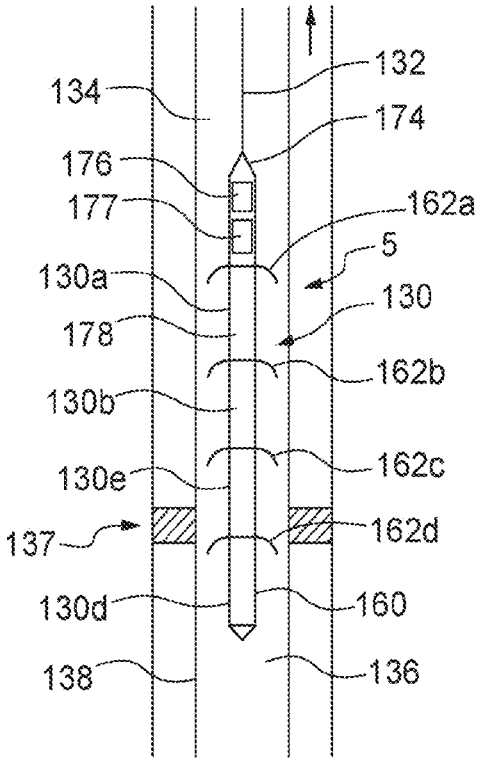
FIG. 4 is a schematic of downhole heating apparatus in accordance with a third example of an aspect of the disclosure in an activated configuration.

Reference is now made to FIG. 4 of the drawings, a schematic of downhole heating apparatus in accordance with a third example of an aspect of the disclosure. The apparatus is illustrated in FIG. 4 in an activated configuration. In this example, an extended length heater 130 comprising one or more axial segments 130*a-d* (in the illustrated example, four segments) is suspended on a wireline 132 in a fluid-filled bore 134. The heater 130 comprises a generally cylindrical body 160 having four axially spaced heat deflectors 162*a-d*. In the running configuration, the heat deflectors 162*a-d* are restrained in a retracted position but as will be described below, on activation of the heater 130 the deflectors 162*a-d* are reconfigured to extend radially outwards from the body 160 and into contact with the bore wall.

The heater 130 is elongate and generally cylindrical and, as noted above, is run into the bore 134 on a suitable support member, typically electric wireline 132. Accordingly, an upper end of the heater 130 includes a wireline coupling 174. Immediately below the coupling 174 is a power control module 176 which supplies the power used to initiate the thermite reaction. A pressure/temperature sensitive switch module 177 is provided below the power control module 176 and is used to avoid premature initiation of the volume of thermite 178 which extends through the body 160.

The heater 130, in this example, is a top-down exothermic reaction thermite heater, in which the thermite reaction is initiated at the upper end of the heater and then progresses down through the heater 130.

The heater 130 may be initially located in the bore 134 with the uppermost heater segment 130*a* adjacent the casing area 137 to be heated. When the thermite reaction is initiated at the upper end of the thermite volume 178, the uppermost volume of thermite begins to react and generate heat, the reaction then progressing downwards through the volume 178. The rate of progress of the reaction through the volume 178 can be controlled by, for example, the thermite composition, thermite particle size, and degree of thermite compression.

Figure 5:
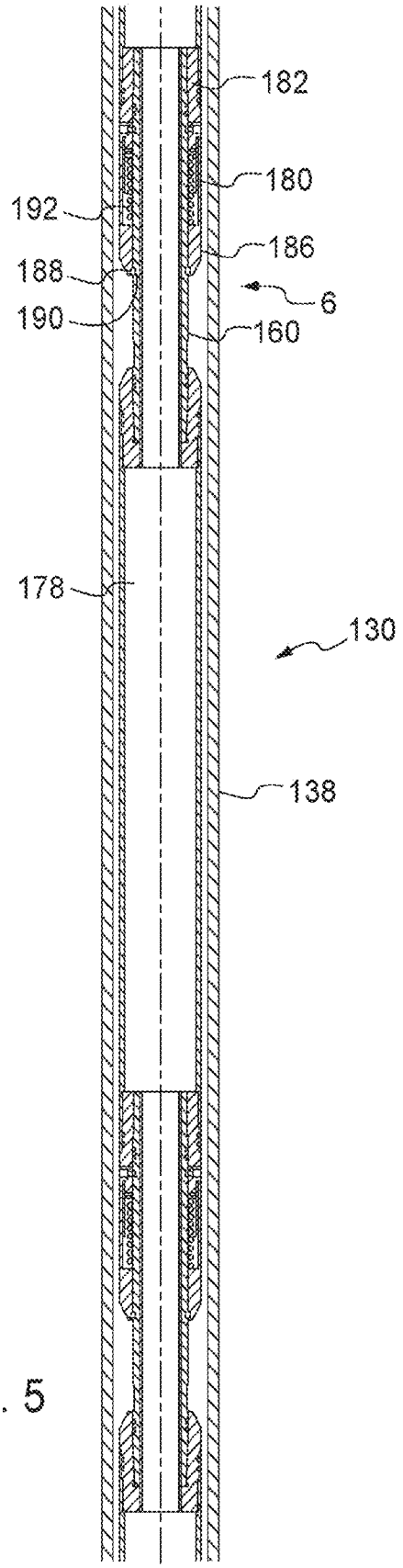
FIG. 5 is an enlarged sectional view of area 5 of the heating apparatus of FIG. 4, shown in a running configuration.
Figure 6:
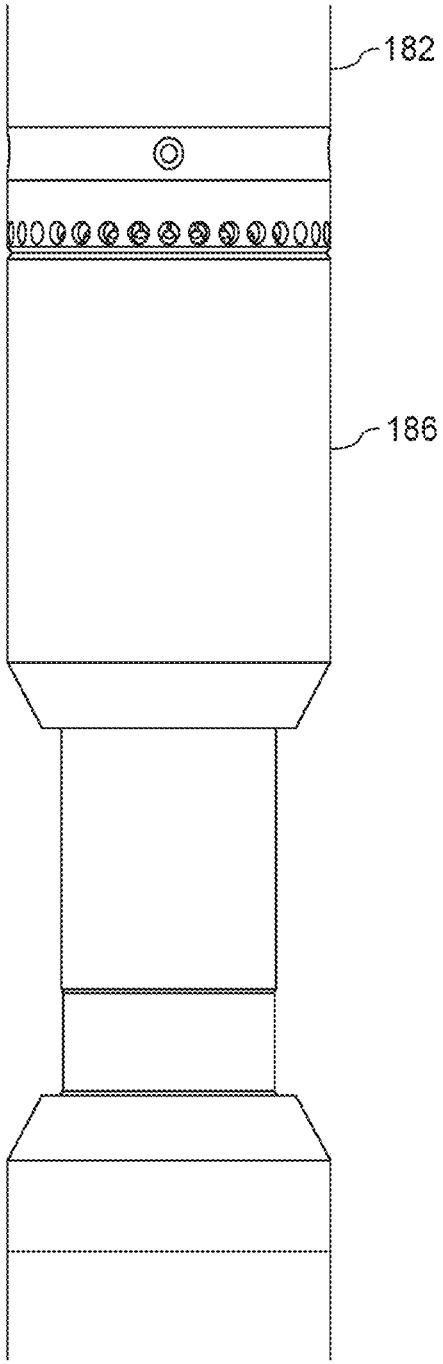
FIG. 6 is an enlarged external view of area 6 of FIG. 5.

The uppermost heat deflector 162*a* is provided around the uppermost end of the thermite volume 178 and is illustrated in greater detail in FIGS. 5 to 8 of the drawings. The deflector 162*a* comprises multiple spring steel petals 180, an upper end of each petal 180 being secured to a collar 182 mounted on the body 160 by a threaded pin 184. A single layer of petals may be provided, or two or more layers of petals may be provided. A layer of silicone or the like may be provided between the layers of petals. The petals 180 are initially restrained in a retracted position, as illustrated in FIGS. 5 and 6, by a sleeve 186. The sleeve 186 itself is initially restrained in an upper position, around the petals 180, by a fusible ring 188 which sits in an external body groove 190. An axial coil spring 192 provided radially inwards of the petals 180 urges the sleeve 186 downwards, but movement of the sleeve 186 is initially prevented by the ring 188.

Figure 7:
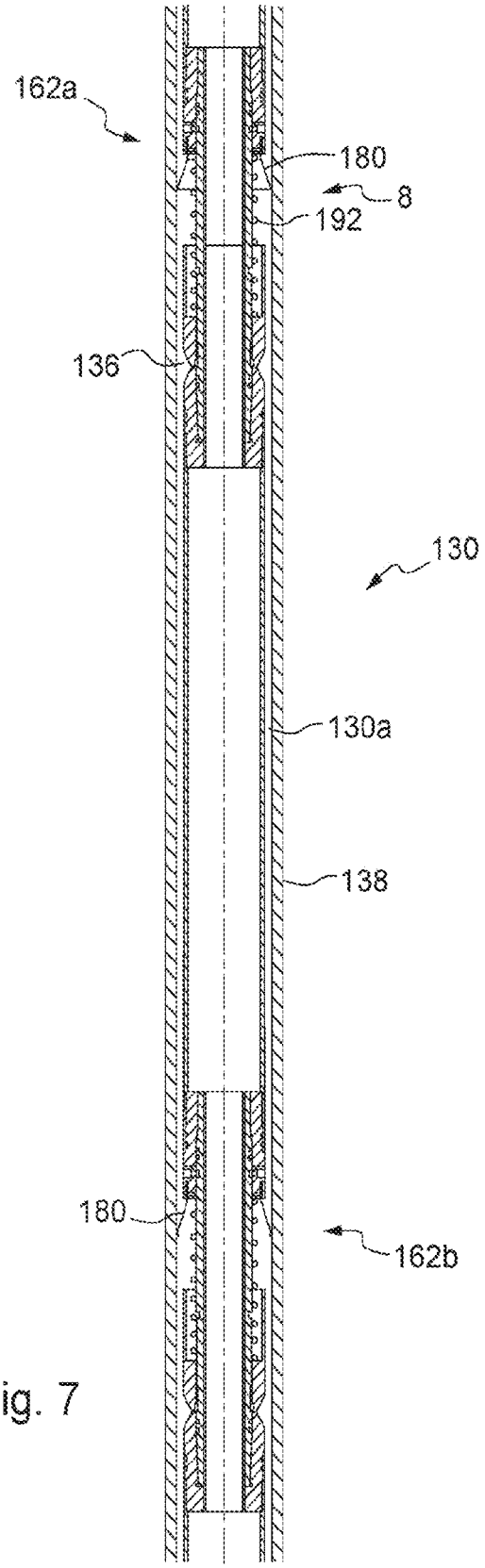
FIG. 7 is an enlarged sectional view of area 5 of the heating apparatus of FIG. 4, shown in an activated configuration.
Figure 8:
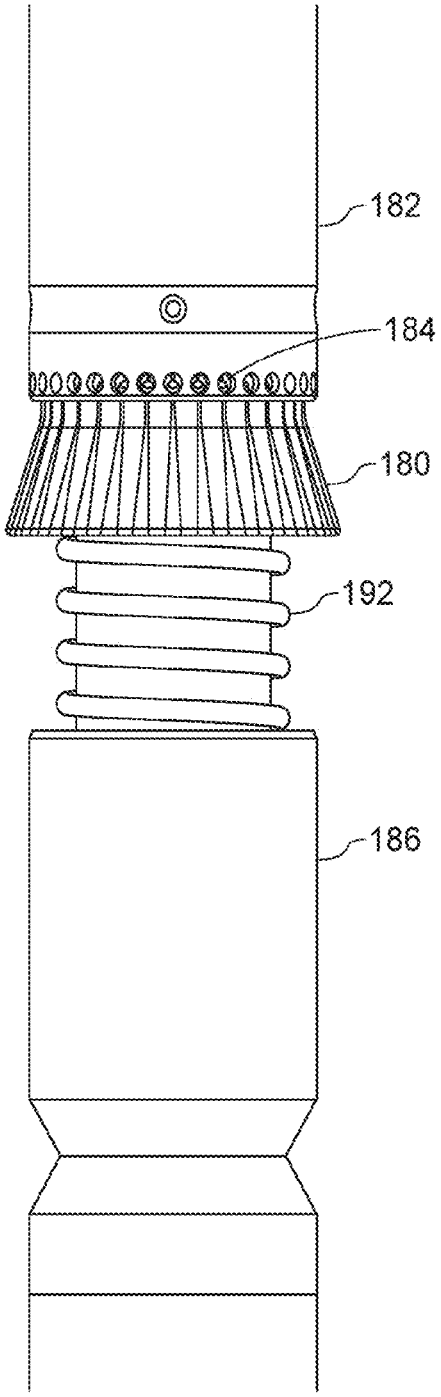
FIG. 8 is an enlarged external view of area 8 of FIG. 7.

As the thermite in the upper end of the segment 130*a* reacts and generates heat, the ring 188 will soften or fluidise, allowing the sleeve 186 to move downwards and release the petals 180, such that the petals 180 extend radially outwards from the body 160 and into contact with the bore wall 194 to create the uppermost heat deflector 162*a*, as illustrated in FIGS. 7 and 8. Thus, as the thermite reaction progresses downwards through the segment 130*a* and generates additional heat, the deflector 162*a* restricts the upwards movement of heated fluid 136 from the volume around the activated thermite. The temperature of the fluid 136 between the heater 130 and the area 137 thus increases rapidly, with minimal convection losses to the fluid above the deflector 162*a*.

As the thermite reaction moves downwards, the upper segment 130*a* will begin to cool and the temperature of the next segment 130*b* will increase. As the thermite reaction passes into the upper portion of the segment 130*b*, the second set of petals 180 will be released to create a further heat deflector 162*b* and restrict movement of the fluid 136 surrounding the segment 130*b*.

In a similar fashion, the thermite reaction will continue down through the heater 130, activating the thermite in the third and fourth segments 130*c*, 130*d*, and activating the third and fourth heat deflectors 162*c*, 162*d*.

The operator will be aware of the rate of advancement of the reaction through the heater 130 and may optionally raise the heater 130 in the bore 134 to position the next segment 130*b* adjacent the casing area 137. This raising process could be continued as the thermite reaction progresses down through the heater 130, such that the hottest portion of the heater 130 is always located adjacent the area to be heated 137. In other examples the heater 130 may remain stationary in the bore 134.

Once the heater operation has concluded, the operator may retrieve the heater 130 to the surface. The outer edges of the deflectors 162 will slide over the surface of the bore-lining casing 138 and if the extended heat deflectors 162 encounter a bore restriction the petals 180 may deflect radially inwards to define a smaller diameter and permit passage of the heater 130.

In an alternative example, the heater 130, may be configured as a bottom-up exothermic reaction thermite heater, in which the thermite reaction is initiated at the lower end of the heater and then progresses up through the heater. In this configuration the heat deflectors may be activated, following initiation, by the increase in temperature from the heater which, by any combination of convection, conduction, or radiation, melts the fusible ring 188 and releases the sleeve 186 to permit extension of the petals 180.

The skilled person will understand that alternative heater activation methods and arrangements may be employed.

Figure 9:
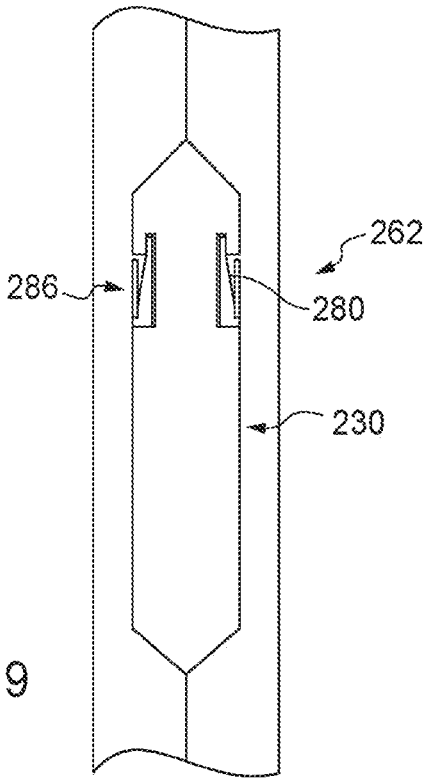
FIGS. 9 and 10 are views of an alternative heat deflector.
Figure 10:
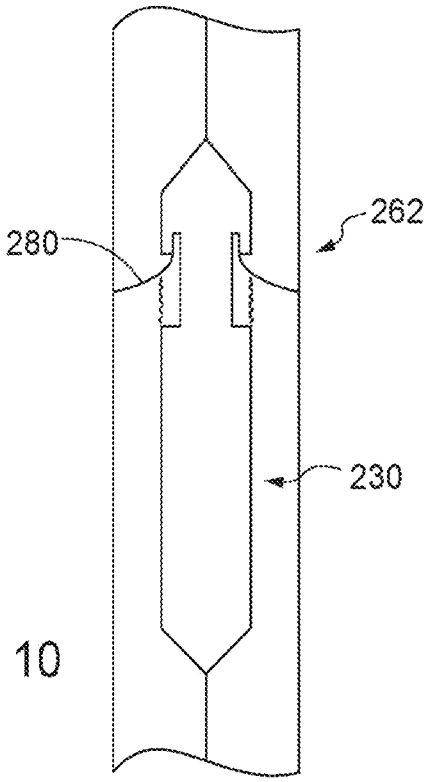

Furthermore, in other examples, such as illustrated in FIGS. 9 and 10 of the drawings, a heater 230 may be provided with at least one deflector 262 including petals 280 that are retained in a retracted position (FIG. 9) by a fusible collar or sleeve 286 comprising a low melting point material. Following activation of the heater 230, the low melting point material of the sleeve 286 is softened and allows the petals 280 to extend (FIG. 10).

Figure 11:
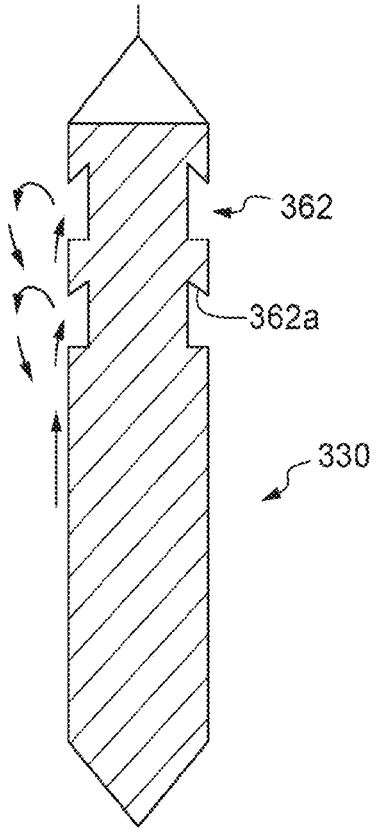
FIG. 11 is a schematic of a heater in accordance with a fourth example of an aspect of the disclosure.

Reference is now made to FIG. 11 of the drawings, a schematic of a heater 330 in accordance with a fourth example of an aspect of the disclosure. In this example convection induced flow is restricted or disrupted by provision of multiple formations 362 on an external surface of the heater 330. The formations 362 are arranged to induce lateral deflections in the axial flow of warmed fluid passing over the heater surface, in a similar manner to a Tesla valve, as described in U.S. Pat. No. 1,329,559. Such lateral deflections significantly disrupt the convection current and reduce the convective velocity.

In this example the formations 362 are circumferential recesses in the outer diameter of the heater body. An upper end surface 362*a* of each formation extends radially outwards and axially downwards. Thus, fluid passing upwards over the heater 330 flows into the recess and on encountering the surface 362*a* is deflected radially outwards and downwards. This disruption of the convection current significantly reduces the loss of heat energy from the area immediately surrounding the heater 330.

Figure 12:
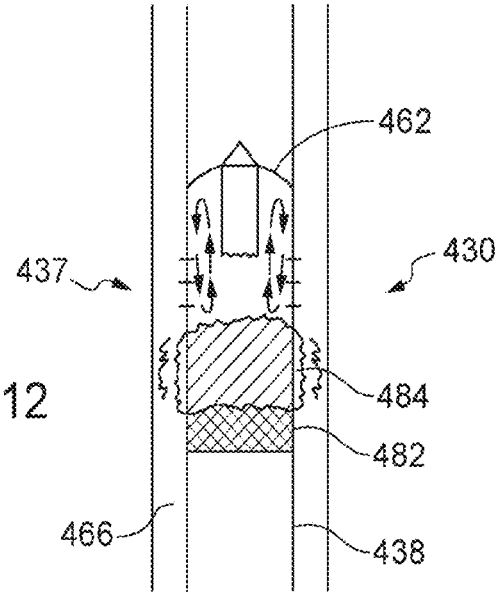
FIG. 12 is a schematic of a downhole heating method in accordance with a fifth example of an aspect of the disclosure.

Reference is now made to FIG. 12 of the drawings, a schematic of a downhole heating method in accordance with a fifth example of an aspect of the disclosure. In this example an exothermic heat source 430, for example thermite, has been located above a barrier 482 and the exothermic reaction activated. As described in, for example, our earlier WO 2020/144091, the disclosure of which is incorporated herein in its entirety, the composition of the thermite may be selected to provide thermite reaction products 484 that are relatively mobile and will flow until the temperature of the reaction products fall and the material solidifies. Alternatively, or in addition, the exothermic reaction material may be delivered into the wellbore in a liquid state and thus be mobile or flowable before the reaction takes place. In this example the casing 438 has been perforated such that the thermite reaction products 484 may flow into the annulus 466, and potentially into the surrounding rock formation.

As the thermite reaction products 484 flow, they will cool as the molten material 284 encounters other, cooler downhole structures and materials, such as the casing 438, the barrier 482, and the fluid 436, 472 in the bore 434 and the annulus 466. When the temperature of the leading face of the flowing material 484 falls to the freezing temperature of the material, the material will begin to solidify, preventing further outward travel and penetration of the material.

By providing the heater 430 with a deflector 462, more of the heat energy generated by the thermite is directed into the bore zone 437 immediately adjacent the heater 430, such that the downhole structures and materials immediately adjacent the heater 430 will experience a greater rise in temperature and/or remain at an elevated temperature for a longer time period, and the molten thermite reaction products 484 will flow further before freezing.

It will be apparent to the skilled person that the various arrangements described above are merely examples of the aspects of the disclosure, and that various modifications and improvements may be made to these examples without departing from the scope of the disclosure, such as those described below.

A heat deflector in accordance with the present disclosure may take various forms. For example, the deflector may be a resettable packer, a collapsible junk basket or the like, and may be provided above the heat source.

The heater may be provided for various purposes. For example, the heater may be used to heat an object or material located in the bore, such as a volume of alloy or metal. The object or material may be run into the bore with the heater, may be run into the bore separately of the heater, or the object or material may have been incorporated in the bore during an earlier operation. Thus, the heater may be used to, for example, heat and soften a sealing material, such as low melting point alloy, which then moves or flows and subsequently cools and hardens in a sealing configuration, for example forming a plug in the bore. Conversely, the heater may be used to soften an existing plug, to allow the plug to be removed or assume a non-sealing configuration. Alternatively, or in addition, the heater may be used to heat the bore wall, for example bore-lining tubing, or material surrounding the wall, such as cement, rock formations surrounding the bore, or annulus fluid. In other examples the heater may be used to melt or remove an existing wellbore structure, for example the heater may melt or cut a section of tubing or casing. As illustrated in FIG. 12, elements of the activated heater may move or flow to form an obstruction in the wellbore.

Heating apparatus as described herein may be provided in combination with any of the features described in applicant's previous patent applications, including WO 2020/144091, WO 2020/2164475, WO 2021/043444, WO 2021/43344, and GB2586796, the disclosures of which are incorporated herein in their entirety. The disclosure also relates to an arrangement for restricting convention-induced flow that may be provided separately of a heater, for example a heat deflector or flow disrupter that is run into a bore separately of a heater.

It will also be obvious to a person skilled in the art that the creation of an annular restriction may be achieved by means other than expanding the casing as illustrated in FIG. 3. For example, a similar effect would be achieved by heating the wellbore under a conventional packer or liner hanger which seals the annulus surrounding the casing.

The invention claimed is:

1. A downhole heating method comprising:

providing a heater and a heat deflector, and retaining the heat deflector in a retracted configuration with a fusible retainer;

locating the heater and the heat deflector in a fluid-filled downhole bore;

activating the heater to heat the bore and the fluid therein, and to heat the fusible retainer and reconfigure the heat deflector from the retracted configuration to an extended configuration to restrict convection-induced flow of the heated fluid.

2. The method of claim 1, wherein the heat deflector is biased to assume the extended configuration, and the method further comprises restraining the heat deflector in the retracted configuration and heating the fusible retainer to permit the heat deflector to reconfigure to the extended configuration.

3. The method of claim 2, wherein restraining the heat deflector comprises locating a retaining member around the heat deflector.

4. The method of claim 3, wherein the retaining member is axially movable, and the fusible retainer maintains the retaining member around the heat deflector and further comprising heating the fusible retainer whereby the retaining member axially translates, and the heat deflector reconfigures to the extended configuration.

5. The method of claim 1, comprising restricting axial flow of the fluid in an annular volume around the heater.

6. The method of claim 1, comprising providing an elongate exothermic reaction heater, activating the heater at one end whereby a heating reaction translates axially through the heater, and translating the heater to locate an activated portion of the heater at a selected location in the bore.

7. The method of claim 1, comprising restricting convection-induced flow in an annulus surrounding a bore-lining tubing by deforming the bore-lining tubing to extend into the annulus.

8. A downhole heater comprising a body for location in a bore, a heat deflector and a fusible retainer, the heat deflector having a retracted configuration and a larger diameter extended configuration for restricting convection-induced flow in the bore, the heat deflector being maintained in the retracted configuration by the fusible retainer whereby the heat deflector is reconfigured to the larger diameter extended configuration on activation of the heater.

9. The heater of claim 8, wherein the heat deflector comprises a heat-deflecting member having a first end fixed to the body and a second end radially movable relative to the body, and a retaining member for retaining the heat-deflecting member in the retracted configuration.

10. The heater of claim 9, wherein the heat deflector comprises an axially movable sleeve having a first configuration for surrounding and radially retaining the second end of the heat-deflecting member, and wherein the fusible retainer has a first configuration and a second configuration and in the first configuration the fusible retainer restricts axial movement of the sleeve.

11. The heater of claim 9, wherein the fusible retainer comprises the retaining member and the retaining member comprises a collar for radially restraining the second end of the heat-deflecting member.

12. The heater of claim 8, wherein the body contains an axially extending volume of thermite and the heat deflector is mounted on the body externally of an upper end of the volume of thermite.

13. The heater of claim 8, wherein the heater comprises a volume of thermite and has an initiator at one end of the volume of thermite, whereby a thermite reaction may be initiated at said one end and progress through the thermite to the other end.

14. The heater of claim 13, wherein the initiator is provided at an upper end of the volume of thermite.

15. The heater of claim 8, further comprising means for restricting convection-induced flow of heated fluid comprising a heater surface configured to induce lateral deflections in axial flow of fluid passing over the heater surface.

16. The heater of claim 8, wherein the heat deflector is biased towards the extended configuration.

17. The heater of claim 8, wherein the heat deflector comprises a disc.

18. The heater of claim 8, wherein the heat deflector comprises a plurality of petals.

19. The heater of claim 8, wherein at least one heat deflector is provided at an upper end of the heater.

20. The heater of claim 8, comprising multiple axially spaced heat deflectors.

* * * * *